US007047597B2

(12) United States Patent
Lee

(10) Patent No.: US 7,047,597 B2
(45) Date of Patent: May 23, 2006

(54) HINGE FOR FOLDING LADDERS

(75) Inventor: Sang Kyu Lee, Kyounggi-Do (KR)

(73) Assignee: Chan Bok Lee, Cheongju (KR)

( * ) Notice: Subject to any disclaimer, the term of this patent is extended or adjusted under 35 U.S.C. 154(b) by 65 days.

(21) Appl. No.: 10/780,289

(22) Filed: Feb. 17, 2004

(65) Prior Publication Data

US 2004/0216954 A1 Nov. 4, 2004

(30) Foreign Application Priority Data

Feb. 19, 2003 (KR) ..... 20-2003-0004831 U

(51) Int. Cl.
*E06C 1/00* (2006.01)

(52) U.S. Cl. ..... 16/233; 182/194; 182/163

(58) Field of Classification Search ..... 16/231, 16/233, 324–326, 327–329; 182/163, 22–26, 182/194; D25/64, 65; 403/92, 93, 96–98, 403/102, 329, 330

See application file for complete search history.

(56) References Cited

U.S. PATENT DOCUMENTS 3,879,146 A * 4/1975 Mayer ..... 403/93
4,540,306 A * 9/1985 Wang ..... 403/93
4,543,006 A * 9/1985 Wang ..... 403/93
4,666,328 A * 5/1987 Ryu ..... 403/92
4,770,559 A 9/1988 Yoo
4,890,950 A * 1/1990 Yoo ..... 403/96
4,914,783 A * 4/1990 Jackson et al. ..... 16/363
5,620,272 A * 4/1997 Sheng ..... 403/96
5,992,566 A * 11/1999 Yeh ..... 182/163
6,343,406 B1 * 2/2002 Yeh ..... 16/328
6,688,797 B1 * 2/2004 Park et al. ..... 403/93

OTHER PUBLICATIONS

U.S. Appl. No. 10/800,126, "Safety Unit of Hinge for Folding Ladder", filed Mar. 12, 2004.

* cited by examiner

*Primary Examiner*—Robert J. Sandy
*Assistant Examiner*—Andre' L. Jackson
(74) *Attorney, Agent, or Firm*—McCarter & English, LLP

(57) ABSTRACT

Disclosed herein is a hinge for a folding ladder having first and second ladder frames. The hinge includes a main hinge unit, a subsidiary hinge unit, and a locking unit. The main hinge unit includes first and second support arms commonly mounted to an upper end of the first ladder frame, and first and second disc parts extending from upper ends of the first and second support arms, respectively, and being spaced apart from each other by a predetermined interval. The subsidiary hinge unit includes a subsidiary support arm mounted to an upper end of the second ladder frame, and a subsidiary disc part extending from an upper end of the subsidiary support arm, the subsidiary disc part being disposed between the first and second disc parts, with a plurality of notches being provided along a peripheral edge of the subsidiary disc part. The locking unit includes a locking block to engage into one of the plurality of notches of the subsidiary hinge unit, thus preventing both the main and subsidiary hinge units from rotating relative to each other, a press knob outwardly projected from the first disc part and being coupled to the locking block by a coupling shaft, and a return spring fitted over the coupling shaft to return the press knob and the locking block to original positions thereof.

3 Claims, 7 Drawing Sheets

PRIOR ART

PRIOR ART

HINGE FOR FOLDING LADDERS

BACKGROUND OF THE INVENTION

1. Field of the Invention

The present invention relates generally to hinges for folding ladders, and more particularly to a hinge which allows a ladder to be folded and unfolded.

2. Description of the Related Art

As shown in FIG. 1, a ladder includes first and second ladder frames 1 and 1', and two hinges 10. The hinges 10 are rotatably provided at upper ends of the first and second ladder frames 1 and 1' to allow the ladder to be folded and unfolded, in addition to joining the first and second ladder frames 1 and 1' to each other.

The conventional hinge 10 for ladders was disclosed in U.S. Pat. No. 4,770,559. As shown in FIG. 2, the hinge 10 includes a main hinge unit 100, a subsidiary hinge unit 200, a locking unit 300, and a rotating disc 400.

The main hinge unit 100 includes first and second disc parts 110 and 130 which are spaced apart from each other while being parallel to each other. The first and second disc parts 110 and 130 have shaft holes 111 and 131, respectively. Further, first and second support arms 120 and 140 integrally extend from lower ends of the first and second disc parts 110 and 130, respectively.

The subsidiary hinge unit 200 includes a subsidiary disc part 210 which has at a center thereof a shaft hole 211.

The subsidiary disc part 210 includes a rectangular slot 212, a first spring support hole 213 which supports a first end of a coil spring 230, a projection (not shown) which limits the displacement of the rotating disc 400, and a plurality of notches 214 provided along a peripheral edge of the subsidiary disc part 210.

The locking unit 300 includes a press knob 310, a locking block 340, and a coupling shaft 320 which couples the press knob 310 and the locking block 340 to each other. Further, a locking unit support part 132 is provided at a junction of the second disc part 130 and the second support arm 140. In this case, the locking block 340 is slidably mounted by a elasticity of a spring 330 which is supported at both ends thereof by the press knob 310 and the locking block 340.

The rotating disc 400 includes at a central portion thereof a shaft hole 410. A rectangular slot 420 is provided on the rotating disc 400 to correspond to the slot 212 of the subsidiary disc part 210, a slot 112 of the first disc part 110, and the locking unit support part 132 of the second disc part 130. The rotating disc 400 also includes a second spring support hole 430 to support a second end of the coil spring 230. An arc-shaped slot 440 is provided on a predetermined portion of the rotating disc 400 so that the projection (not shown) of the subsidiary hinge unit 200 is inserted into the arc-shaped slot 440. Further, a plurality of cutouts 450 are provided along a peripheral edge of the rotating disc 400.

The main and subsidiary hinge units 100 and 200 are connected to each other by a shaft 150 so that the main and subsidiary hinge units 100 and 200 rotate relative to each other. While a position of the rotating disc 400 is controlled by the coil spring 230, the projection (not shown), and the arc-shaped slot 440, the locking unit 300 engages into one of the notches 214 provided along the peripheral edge of the subsidiary disc part 210, so that the main and subsidiary hinge units 100 and 200 are locked at a desired angular position.

When a user desires to control an angle between the main and subsidiary units 100 and 200 so as to fold or unfold the folding ladder, the press knob 310 is pressed so that the locking block 340 disengages from the notch 214 of the subsidiary hinge unit 200. Thereafter, the angle between the main and subsidiary units 100 and 200 is controlled as desired.

Since the operation of the hinge for folding ladders is known, the operation of the hinge will not be described in detail herein.

In the hinge for folding ladders which is described above, the coil spring 230 is outwardly projected from the rectangular slot 420 of the rotating disc 400 to be in contact with an inner surface of the first disc part 110.

Thus, when the hinge for folding ladders is operated, the main and subsidiary hinge units 100 and 200 rotate relative to each other, the coil spring 230 disposed between the main and subsidiary hinge units 100 and 200 comes into contact with inner surfaces of both the first and second disc parts 110 and 130 of the main hinge unit 100. As such, when the coil spring 230 continuously contacts with the inner surfaces of the first and second disc parts 110 and 130, the coil spring 230 is stressed due to friction between the inner surfaces of the first and second disc parts 110 and 130 and the coil spring 230. In case where the coil spring 230 is excessively stressed, the coil spring 230 may be deformed or broken.

Further, a torsion stress generates on the rotating disc 400 due to a restricted rotation of the coil spring 230. When the torsion stress continuously generates on the rotating disc 400, the rotating disc 400 may be deformed, thus causing malfunction of the hinge.

The above-mentioned problems may cause the user to be injured, and further may risk the user's life. Such problems need be solved to insure user safety while the ladder is in use.

Further, the conventional hinge must be provided with the rotating disc 400 and the coil spring 230, so that it is complicated to assemble the hinge, and thereby the manufacturing costs of the hinge are increased.

SUMMARY OF THE INVENTION

Accordingly, the present invention has been made keeping in mind the above problems occurring in the prior art, and an object of the present invention is to provide a hinge for folding ladders, which needs not a coil spring and a rotating disc that lead to malfunction of the hinge when the coil spring and the rotating disc are broken or deformed, thus insuring the safety of a user when a ladder is in use.

Another object of the present invention is to provide a hinge unit for folding ladders which is not provided with a rotating disc, thus simplifying a structure of the hinge.

In order to accomplish the above object, the present invention provides a hinge for a folding ladder having first and second ladder frames. The hinge includes a main hinge unit, a subsidiary hinge unit, and a locking unit. The main hinge unit includes first and second support arms commonly mounted to an upper end of the first ladder frame, and first and second disc parts extending from upper ends of the first and second support arms, respectively. In this case, the first and second disc parts are spaced apart from each other by a predetermined interval. The subsidiary hinge unit includes a subsidiary support arm mounted to an upper end of the second ladder frame, and a subsidiary disc part extending from an upper end of the subsidiary support arm. The subsidiary disc part is disposed between the first and second disc parts, with a plurality of notches being provided along a peripheral edge of the subsidiary disc part. The locking unit includes a locking block which engages into one of the plurality of notches of the subsidiary hinge unit, thus preventing both the main and subsidiary hinge units from rotating relative to each other, a press knob outwardly projected from the first disc part and coupled to the locking block by a coupling shaft, and a return spring fitted over the coupling shaft to return the press knob and the locking block to original positions thereof.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
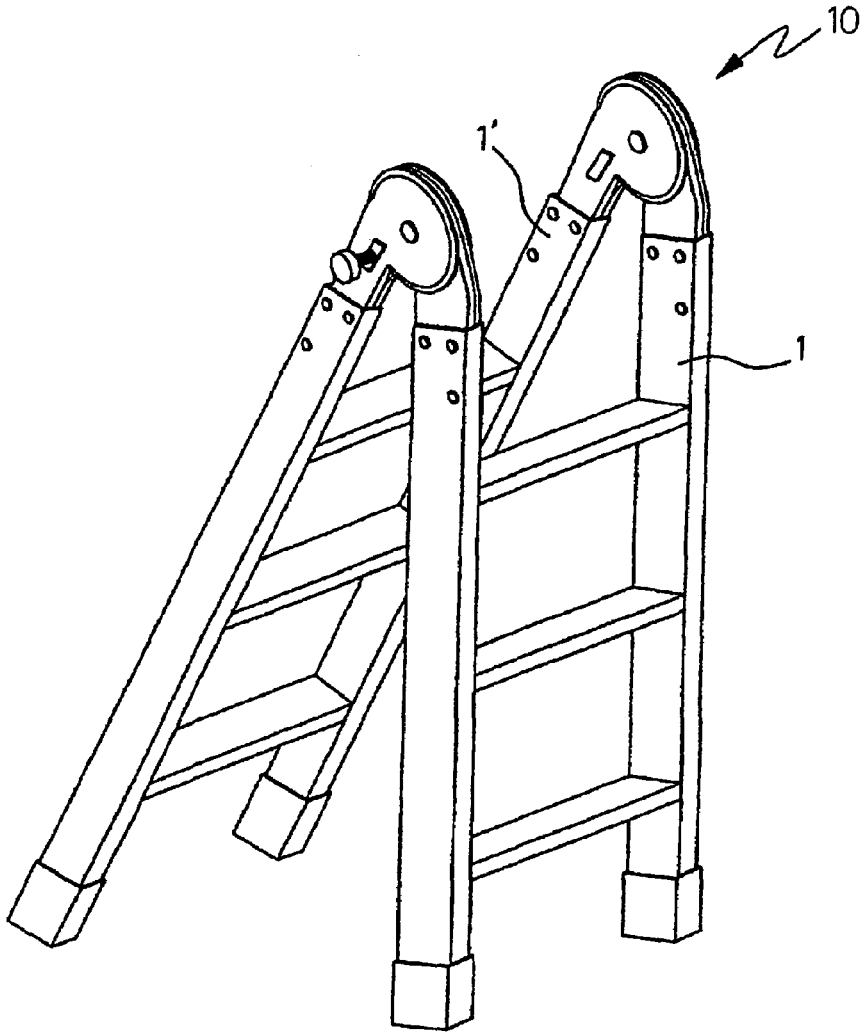
FIG. 1 is a perspective view of a ladder with a conventional hinge.
Figure 2:
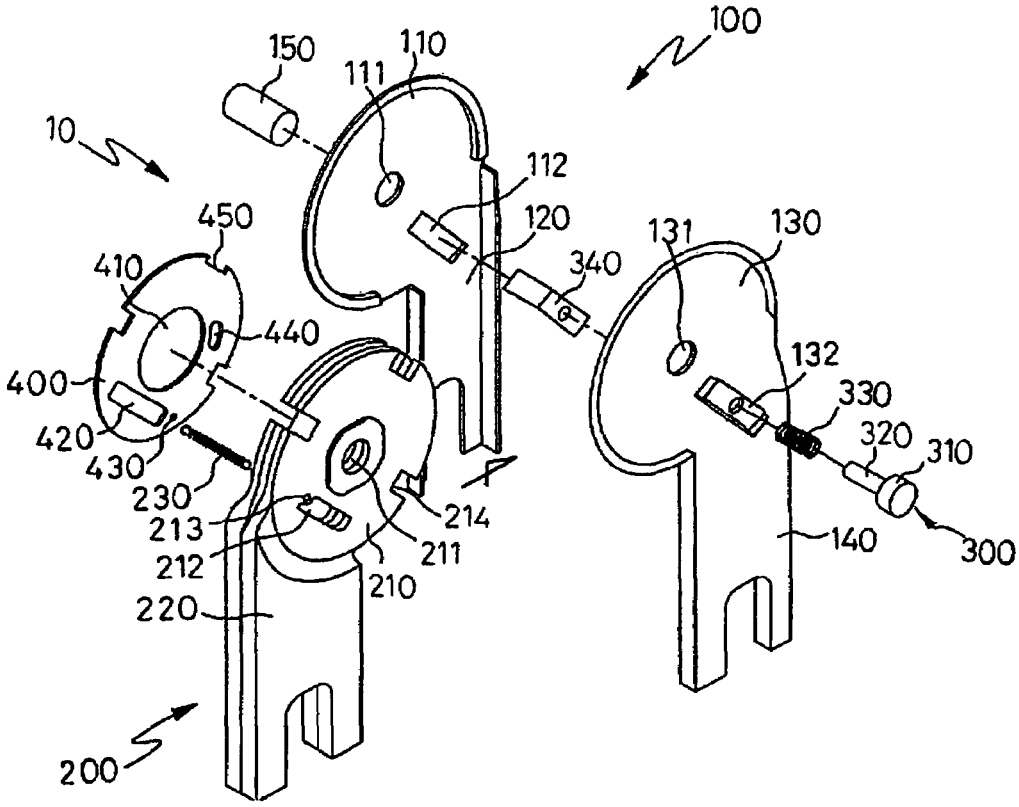
FIG. 2 is an exploded perspective view of the hinge of FIG. 1.

Hereinafter, embodiments of the present invention will be described in detail with reference to the attached drawings.

Reference now should be made to the drawings, in which the same reference numerals are used throughout the different drawings to designate the same or similar components.

Figure 3:
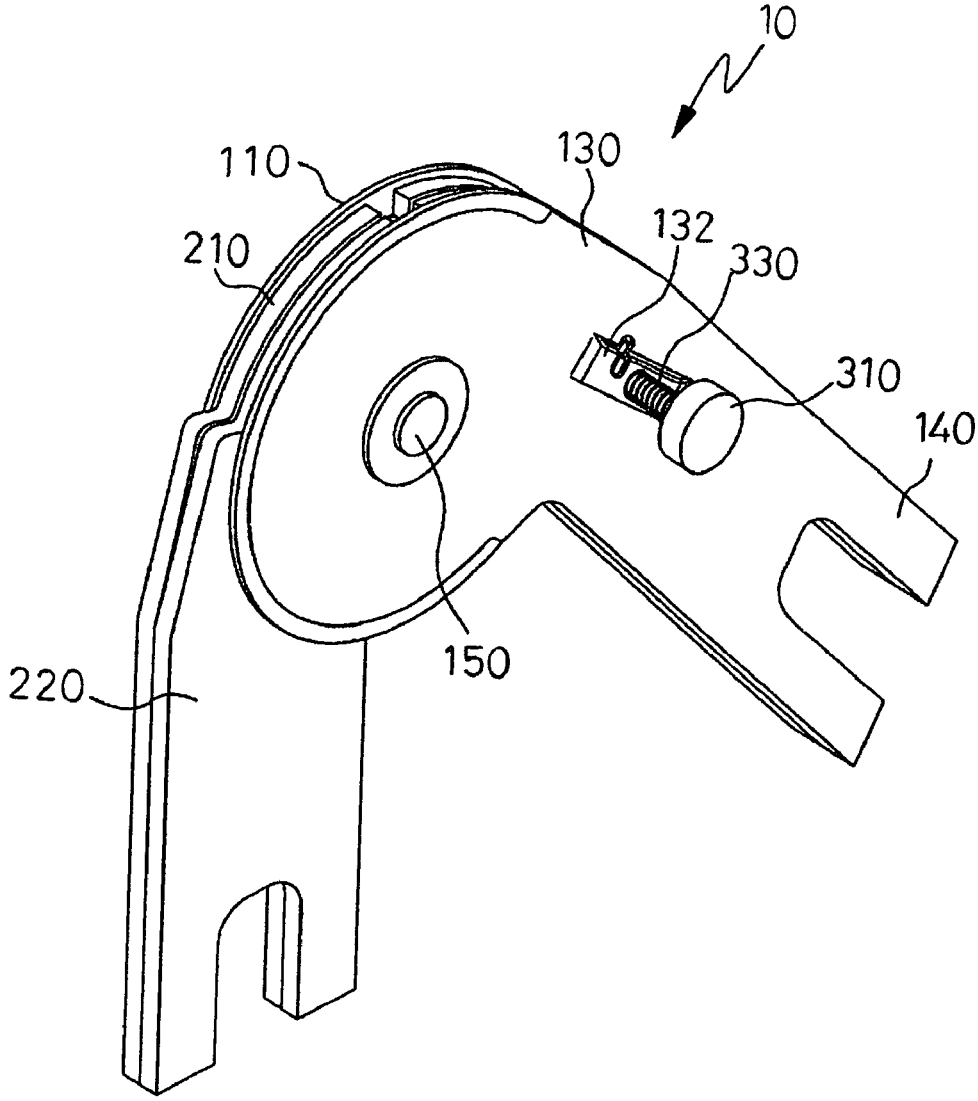
FIG. 3 is a perspective view of a hinge for folding ladders, according to the present invention.
Figure 4:
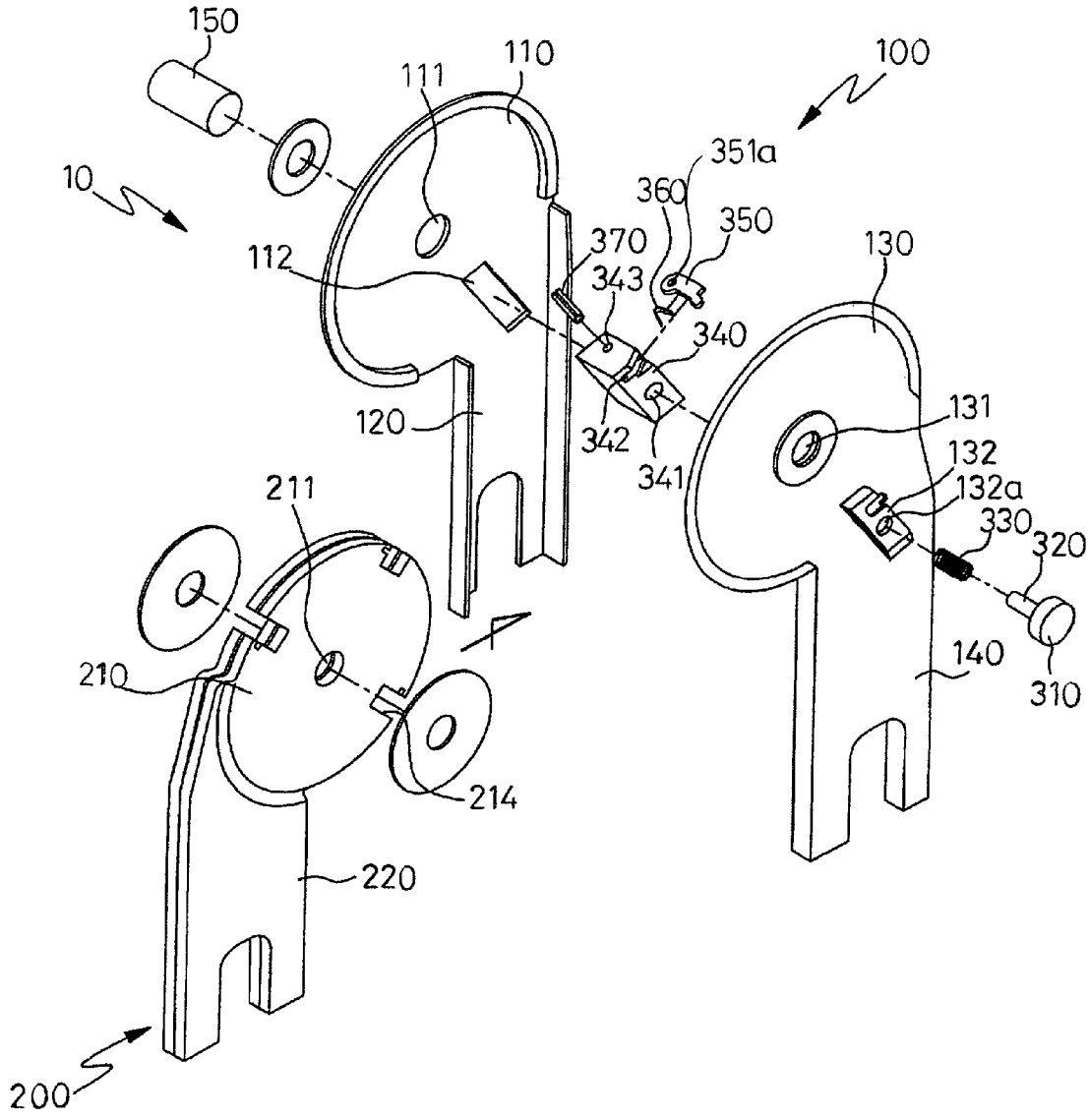
FIG. 4 is an exploded perspective view of the hinge of FIG. 3.

FIG. 3 is a perspective view of a hinge for folding ladders, according to the present invention, and FIG. 4 is an exploded perspective view of the hinge for folding ladders of FIG. 3. The hinge includes a main hinge unit 100, a subsidiary hinge unit 200, and a locking unit 300. The subsidiary hinge unit 200 is provided at a position corresponding to the main hinge unit 100 to be coupled to the main hinge unit 100. The locking unit 300 functions to lock the main and-subsidiary hinge units 100 and 200 at a desired angular position. According to the present invention, the hinge is not provided with a rotating disc and a coil spring which provides elasticity when the rotating disc rotates, differently from a conventional hinge for folding ladders.

The main hinge unit 100 includes first and second disc parts 110 and 130. First and second support arms 120 and 140 integrally extend from lower ends of the first and second disc parts 110 and 130, respectively, so as to be mounted to ladder frames.

Further, first and second shaft holes 111 and 131 are provided on centers of the first and second disc parts 110 and 130, respectively. A rectangular slot 112 is formed on the lower portion of the first disc part 110, and a locking unit support part 132 is provided on the second disc part 130 to correspond to the rectangular slot 112.

The subsidiary hinge unit 200 includes a subsidiary disc part 210 and a subsidiary support arm 220 integrally extending from a lower end of the subsidiary disc part 210.

A subsidiary shaft hole 211 is provided at a center of the subsidiary disc part 210. A plurality of notches 214 are provided along a peripheral edge of the subsidiary disc part 210 at regular intervals so that the locking unit 300 engages into one of the notches 214.

Figure 5:
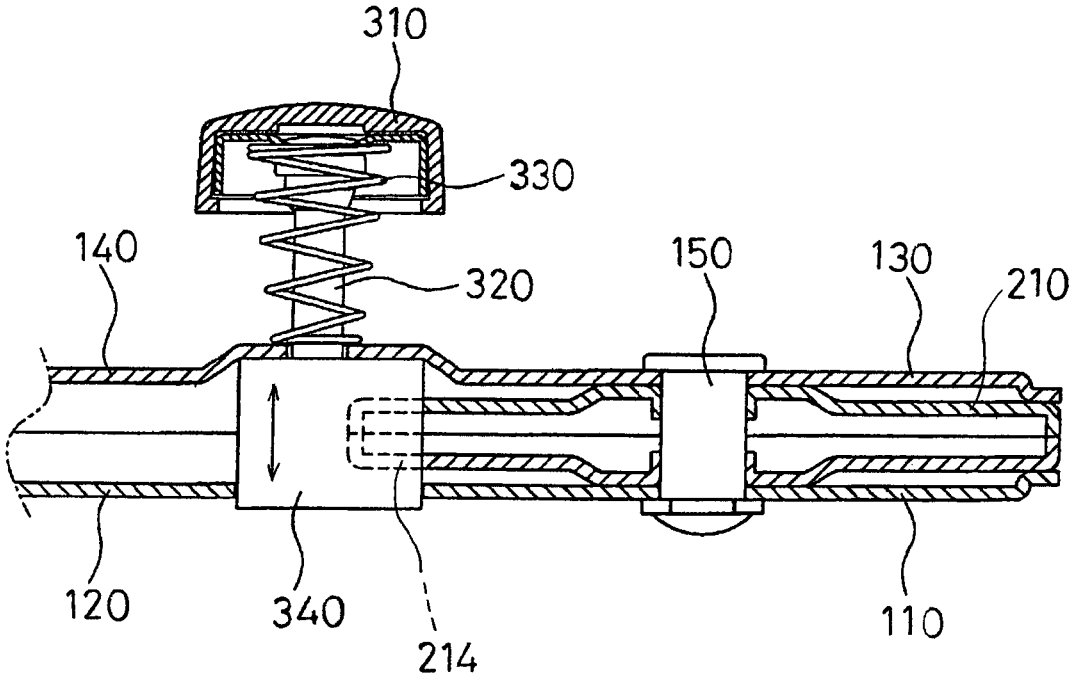
FIG. 5 is a front sectional view to show a part of the hinge of FIG. 3.
Figure 6:
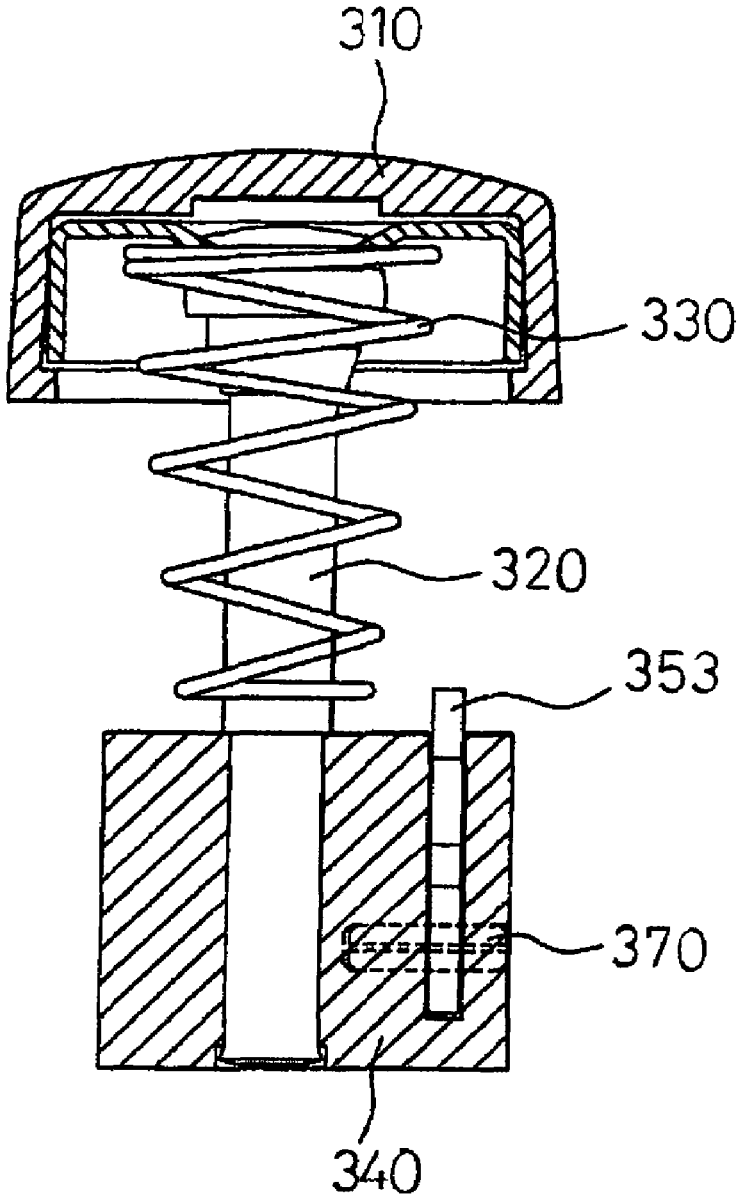
FIG. 6 is a side sectional view to show a part of the hinge of FIG. 3.

As shown in FIGS. 4 through 6, the locking unit 300 includes a locking block 340 which has a hexahedral cross-section and engages into one of the notches 214 to prevent a rotation of the hinge. The locking unit 300 also includes a press knob 310, and a return spring 330. The press knob 310 is coupled to the locking block 340 by a coupling shaft 320, and is outwardly projected from the locking unit support part 132. The return spring 330 is fitted over the coupling shaft 320, and returns the press knob 310 to an original position thereof when the press knob 310 is released.

A shaft hole 341 is provided along a center of the locking block 340 so that the coupling shaft 320 is inserted into the shaft hole 341 of the locking block 340. A guide slot 342 is provided at a predetermined portion of the locking block 340 to be parallel to the shaft hole 341, so that a locking piece 350 described later herein is seated in the guide slot 342. Further, a first pin insert hole 343 is provided at a predetermined portion of the locking block 340 to be perpendicular to the locking slot 342.

A rotating disc part 351 is provided at a predetermined portion of the locking piece 350, and is disposed to correspond to a curved part 344 of the inner surface of the guide slot 342 of the locking block 340. The rotating disc part 351 rotates about a pivot pin 370 at a predetermined angle. A second pin insert hole 351*a* is formed at a position of the rotating disc part 351 to correspond to the first pin insert hole 343. The pivot pin 370 is inserted into both the first and second pin insert holes 343 and 351*a* so that the locking piece 350 seated in the guide slot 342 rotates about the pivot pin 370 at a predetermined angle. In this case, the curved part 344 is formed in the locking block 340 to allow the locking piece 370 to be rotated.

A projection part 352 extends from an end of the rotating disc part 351 to be outwardly projected from the guide slot 342, and a locking step 353 is provided on a side of the projection part 352 to be stopped by an outer surface of the main hinge unit 100.

Further, a torsion spring 360 is placed in the guide slot 342 while being supported at a first end thereof on an inner surface of the guide slot 342, and supported at a second end thereof by a stop shoulder of the locking piece 350 to elastically bias the locking piece 350 to an outside of the guide slot 342.

The operation of the hinge for folding ladders constructed as described above is as follows.

When the slot 112 of the main hinge unit 100 is aligned with one of the notches 214 of the subsidiary hinge unit 200 so that the locking block 340 passes through the main and subsidiary units 100 and 200, the locking block 340 engages into the notch 214 of the subsidiary unit 200 by the elasticity of the return spring 330.

Thereby, the main and subsidiary hinge units 100 and 200 are locked by the locking block 340 of the locking unit 300 so that the main and subsidiary hinge units 100 and 200 are not rotated relative to each other, thus the hinge for folding ladders is locked at a desired angular position.

When a user desires to open the hinge for folding ladders, the locking unit 300 must be released to allow the main and subsidiary units 100 and 200 to rotate relative to each other.

In order to release the locking unit 300, the press knob 310 is pressed, so that the locking block 340 disengages from the notch 214 of the subsidiary unit 200.

Figure 7A:
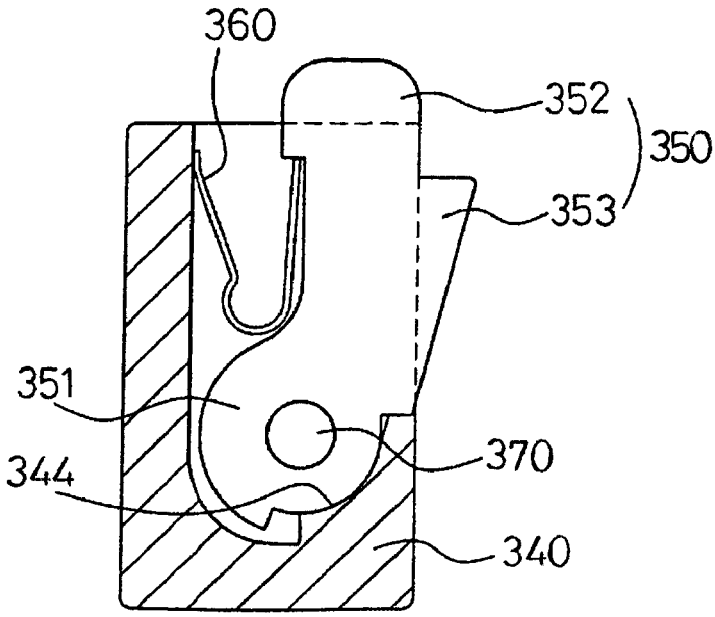
FIGS. 7*a* and 7*b* are sectional views to show operations of a locking unit included in the hinge of FIG. 3.
Figure 7B:
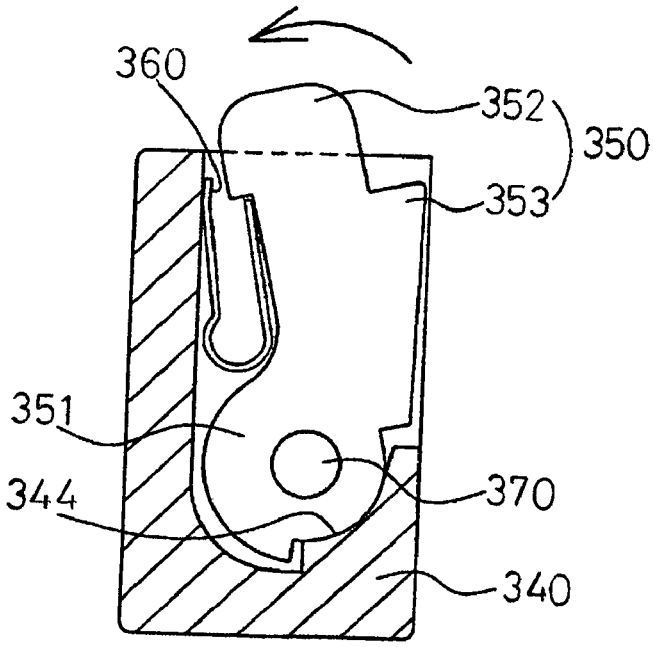

FIGS. 7*a* and 7*b*, respectively, show a state where the locking unit 300 disengages from the notch 214 by the press knob 310 to be outwardly projected from the first disc part 110, and a state where the locking piece 350 is pressed to move the locking block 340 into the first disc part 110, so that the locking block 340 engages into one of the notches 214. When the press knob 310 is pressed, the locking block 340 coupled to the press knob 310 by the coupling shaft 320 moves out of the first disc part 110 through the slot 112 of the first disc part 110 while disengaging from the notch 214.

Further, when the locking block 340 disengages from the notch 214, the locking step 353 of the locking piece 350 is outwardly projected from the main hinge unit 100 by the elasticity of the torsion spring 360 while being stopped by the outer surface of the main hinge unit 100.

The locking step 353 of the locking piece 350 which is outwardly projected from the main hinge unit 100 holds the locking unit 300 so that the locking unit 300 is disengaged from the notch 214 of the subsidiary hinge unit 200, thus preventing the press knob 310 from being restored to the original state thereof by a restoring force of the return spring 330. In such a state, the user may adjust an angle between the ladder frames as desired.

As described above, the present invention provides a hinge for folding ladders which is constructed to insure a safety and maintain an original function without a rotating disc, thus simplifying an assembly operation and reducing the manufacturing costs of the hinge.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A hinge for a folding ladder having first and second ladder frames, the hinge comprising:

a main hinge unit, comprising:

first and second support arms commonly mounted to an upper end of the first ladder frame; and first and second disc parts extending from upper ends of the first and second support arms, respectively, the first and second disc parts being spaced apart from each other by a predetermined interval;

a subsidiary hinge unit, comprising:

a subsidiary support arm mounted to an upper end of the second ladder frame; and a subsidiary disc part extending from an upper end of the subsidiary support arm, the subsidiary disc part being disposed between the first and second disc parts, with a plurality of notches being provided along a peripheral edge of the subsidiary disc part; and a locking unit, comprising;

a locking block to engage into one of the plurality of notches of the subsidiary hinge unit, thus preventing both the main and subsidiary hinge units from rotating relative to each other;

a press knob outwardly projected from the first disc part, the press knob being coupled to the locking block by a coupling shaft; and a return spring fitted over the coupling shaft to return the press knob and the locking block to original positions thereof, wherein the locking block comprises:

a shaft hole provided in a predetermined portion of the locking block to extend through the locking block, with the coupling shaft being inserted into the shaft hole;

a guide slot provided in a predetermined portion of the locking block to be parallel to the shaft hole to allow a locking piece to be seated in the guide slot;

a first pin insert hole provided in a predetermined portion of the locking block to be perpendicular to the guide slot; and a torsion spring placed in the guide slot while being supported at a first end thereof on an inner surface of the guide slot, and supported at a second end thereof by a stop shoulder of the locking piece to elastically bias the locking piece to an outside of the guide slot.

2. The hinge according to claim 1, wherein the locking piece comprises:

a rotating disc part provided at a predetermined portion of the locking piece, the rotating disc part being disposed to correspond to a curved part of the inner surface of the guide slot of the locking block, with a second pin insert hole being formed at a center of the rotating disc part to correspond to the first pin insert hole; and a pivot pin inserted into both the first and second pin insert holes to allow the locking piece to be rotated around the pivot pin at a predetermined angle.

3. The hinge according to claim 2, wherein the rotating disc part of the locking piece further comprises a projection part extending from the rotating disc part to be outwardly projected from the guide slot, with a locking step being provided on a side of the projection part to be stopped by an outer surface of the main hinge unit.

* * * * *